US005571390A

United States Patent [19]

Kimura et al.

[11] Patent Number: 5,571,390

[45] Date of Patent: Nov. 5, 1996

[54] BIPOLAR ION EXCHANGE MEMBRANE ELECTROLYTIC CELL

[75] Inventors: Tatsuhito Kimura, Ichihara; Mikio Suzuki; Takahiro Uchibori, both of Tokyo, all of Japan

[73] Assignee: Asahi Glass Company Ltd., Tokyo, Japan

[21] Appl. No.: 530,623

[22] Filed: Sep. 20, 1995

[30] Foreign Application Priority Data

Sep. 30, 1994 [JP] Japan ..... 6-259775

[51] Int. Cl.[6] ..... C25B 9/04; C25B 13/02

[52] U.S. Cl. ..... 204/254; 204/255; 204/256

[58] Field of Search ..... 204/254, 255, 204/256

[56] References Cited

U.S. PATENT DOCUMENTS 5,082,543 1/1992 Gnann et al. ..... 204/255
5,225,060 7/1993 Noaki et al. ..... 204/237

FOREIGN PATENT DOCUMENTS 0220659 5/1987 European Pat. Off. .
0523669 1/1993 European Pat. Off. .

OTHER PUBLICATIONS

Patent Abstracts of Japan, vol. 5, No. 156 (C–74), Oct. 6, 1981, JP–A–56 087684, Jul. 16, 1981.

*Primary Examiner*—Arun S. Phasge
*Attorney, Agent, or Firm*—Oblon, Spivak, McClelland, Maier & Neustadt, P.C.

[57] ABSTRACT

A bipolar type ion exchange membrane electrolytic cell has gas-liquid separating chambers which minimizes a pressure fluctuation in compartment frame units, deterioration of ion exchange membranes and a voltage variation in the compartment units.

Upper portions of back plates 5, 3*a* are outwardly bent at a higher position than meshed electrode plates of each of anode and cathode compartment frames to form inversed U-shape portions; U-shaped channel members 10 are respectively placed in and fixed to the inversed U-shape portions so that spaces are formed, as passages 12, in association with the back plates, and areas defined by the inversed U-shape portions and the U-shaped channel members are gas-liquid separating chambers.

5 Claims, 3 Drawing Sheets

BIPOLAR ION EXCHANGE MEMBRANE ELECTROLYTIC CELL

BACKGROUND OF THE INVENTION

1. Field of the Invention

The present invention relates to a bipolar ion exchange membrane electrolytic cell.

2. Discussion of the Background

Ion exchange membrane electrolytic cells which have been widely used, are of a filter press (fastening) type electrolytic cell wherein, as shown in FIG. 4, a number of ion exchange membranes 20 and compartment frame units 21 are alternately arranged by interposing gaskets 22 (the thickness is drawn exaggeratedly), and the arranged elements are fastened from both sides by using a hydraulic press or the like. The electrolytic cell of this type is generally classified into a monopolar electrolytic cell of a parallel connection type and a bipolar electrolytic cell of a serial connection type, which are distinguishable from the difference in electrical connection.

In the bipolar ion exchange membrane electrolytic cell, as shown in FIG. 5, a compartment frame unit 21 is formed by connecting an anode compartment frame 30 and a cathode compartment frame 40 back to back. The anode compartment frame 30 for forming an anode compartment 31 comprises a back plate 32 and a meshed electrode plate 33 which is disposed substantially in parallel to the back plate 32 with a certain space to the back plate 32 wherein supporting members or ribs 34 are disposed between the back plate 32 and the anode plate 33 to maintain the above-mentioned space therebetween. Each of the supporting members 34 is provided with a plurality of openings through which electrode liquid or electrolyte can flow in the left and right directions in FIG. 5.

The construction of the cathode compartment frame 40 for providing a cathode compartment 41 is the same as that of the anode compartment frame 30. Namely, it comprises a back plate 42, a meshed cathode plate 43 and supporting members or ribs 44. The back plate 32 is connected integrally with the back plate 42 to form a partition wall for conducting an electric current. A peripheral edge portion of each of the back plates 32, 42 is bent and fixed to a hollow body or a square pipe 24.

FIG. 6 is a front view of the compartment frame unit 21, i.e., a view observed from the cathode side, wherein numeral 27 designates an inlet at the side of the cathode compartment frame 40 through which a cathode liquid or a catholyte is introduced. Numeral 28 designates an outlet for a catholyte and hydrogen gas. Similarly, an inlet **27*a* and an outlet 28*a* for an anode liquid are formed in the anode compartment frame 30**.

In a case of an electrolytic cell for chlor-alkali manufacture, chlorine gas is generated in the anode compartment 31, and hydrogen gas is generated in the cathode compartment 41. Each gas is mixed with the liquid respectively to form a gas-liquid mixed phase stream. The stream goes up in each of the compartments to each gas-liquid separator 29 provided at the upper portion of the compartments where the gas-liquid mixture stream is separated into a gaseous phase and a liquid phase to be discharged from compartments through the outlets 28, **28*a***, respectively.

The gas-liquid separator may be such as disclosed in U.S. Pat. No. 5,225,060 in which a gas-liquid separating chamber is formed in a non-electrolysis area which is in an upper portion of each of the electrode plates, and at least one opening is formed at the bottom of the gas-liquid separating chamber so that the gas-liquid mixed phase stream passing upwardly in the compartments enters into the chamber through the opening.

Further, the gas-liquid separator may be such as disclosed in Japanese Examined Patent Publication No. 46191/1985 in which an L-shaped channel body is disposed in a electrolysis area to form a gas-liquid separating chamber, so that the gas-liquid mixed phase stream enters into the chamber from the electrode side and is discharged therethrough.

In such bipolar ion exchange membrane electrolytic cell, when the discharging of a gas-liquid mixed phase stream is not smoothly discharged, gas stagnates at an upper portion of the compartments. This causes fluctuation of pressure in the compartments; hence, voltage variation. Further, fluctuation of pressure in the compartments causes vibrations of adjacent ion exchange membranes and the ion exchange membranes frequently contact the electrode. Thus, the ion exchange membranes may deteriorate. Accordingly, it is necessary to separate gas quickly from liquid in the gas-liquid separators and to discharge them to the outside of the compartments. For this, the function of the gas-liquid separator is important.

In the gas-liquid separator formed in a non-current conductive, electrolysis area as disclosed in U.S. Pat. No. 5,225,060, gas easily stagnates near the opening formed at the bottom portion of a gas-liquid separating chamber, whereby the fluctuation of pressure in the compartment, the deterioration of ion exchange membrane and the variation of voltage in the compartment take place.

Further, in the gas-liquid separator formed in a current conductive area as disclosed in Japanese Examined Patent Publication No. 46191/1985, the gas-liquid mixed phase stream enters into a gas-liquid separating chamber through a gap or space between a electrode plate and gas-liquid separating chamber. Because the electrode is in a meshed form, gas easily stagnates between the electrode and the ion exchange membrane. Accordingly, the problems arise in that the pressure in the compartment fluctuates, the ion exchange membrane deteriorates and the voltage changes.

SUMMARY OF THE INVENTION

It is a primary object of the present invention to provide a bipolar ion exchange membrane electrolytic cell having a gas-liquid separator which suppresses the fluctuation of pressure in the compartments, the deterioration of ion exchange membranes and the variation of voltage.

In accordance with the present invention, there is provided a bipolar ion exchange membrane electrolytic cell comprising: plural compartment frame units having ion exchange membranes interposed therebetween, each of the compartment frame units including an anode compartment frame and a cathode compartment frame; the anode compartment frame having an anode back plate and an anode meshed electrode plate arranged substantially in parallel, the cathode compartment frame having a cathode back plate and a cathode meshed electrode plate arranged substantially in parallel, the anode and cathode back plates being connected to each other; an inverse U-shaped portion formed by bending an upper portion of each of the anode and cathode back plates; a U-shaped channel member arranged in and fixed to the inverse U-shaped portion such that respective opening ends of the inverse U-shaped portion and the U-shaped channel member face each other to form a gas-liquid separating chamber therein and a passage between the anode or cathode back plate and the U-shaped channel.

In the present invention, a holding member having openings is arranged substantially horizontally in the U-shaped channel member to divide the gas-liquid separating chamber into a gaseous phase chamber and a liquid phase chamber.

Further, in the present invention, the width of the passage is 5–20% of the width of the anode or cathode compartment frame.

Further, in the present invention, the gas-liquid separating chamber has an inlet size which is 5–30% of the height of the gas-liquid separating chamber.

DESCRIPTION OF THE PREFERRED EMBODIMENTS

Preferred embodiments of the present invention will be described in more detail with reference to the drawings.

Figure 1:
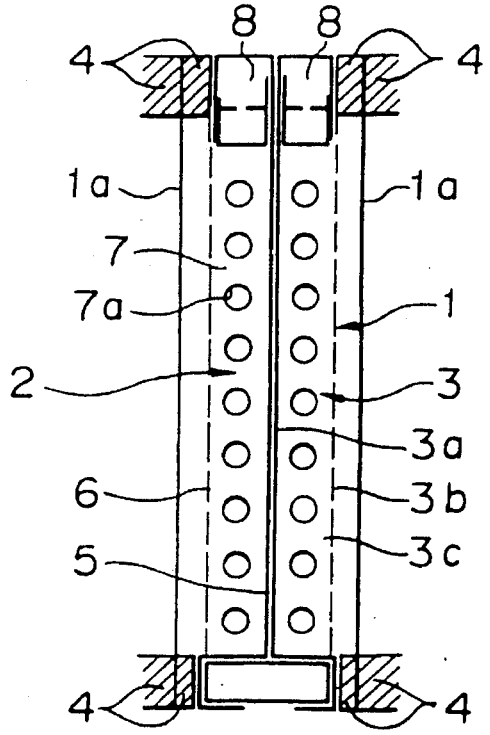
FIG. 1 is a longitudinal sectional view of a part of a bipolar ion exchange membrane electrolytic cell in accordance with an embodiment of the present invention.
Figure 2:
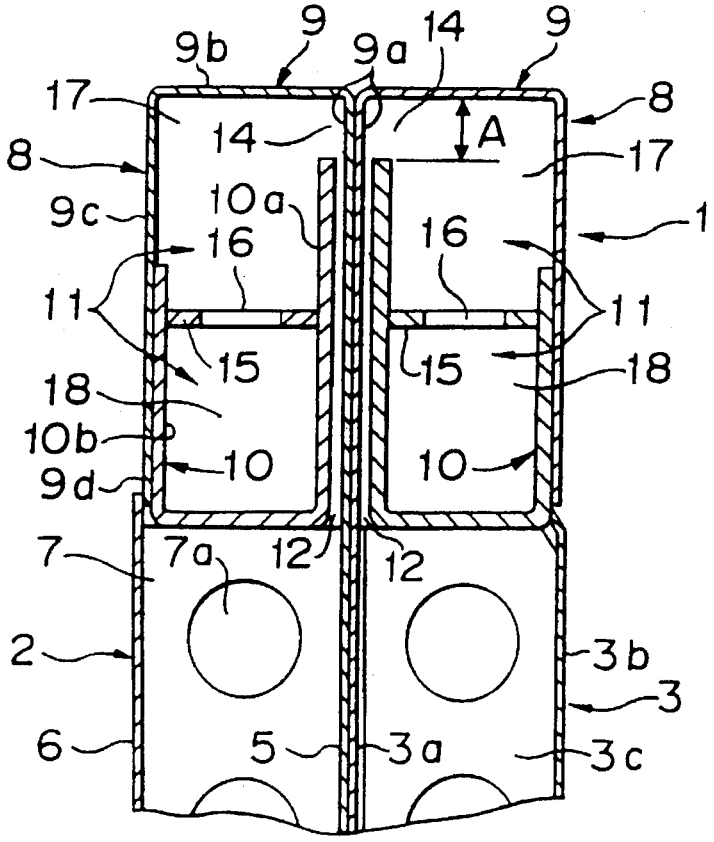
FIG. 2 is a longitudinal cross-sectional view showing a gas-liquid separator and related portions thereof in accordance with an embodiment of the present invention.
Figure 3:
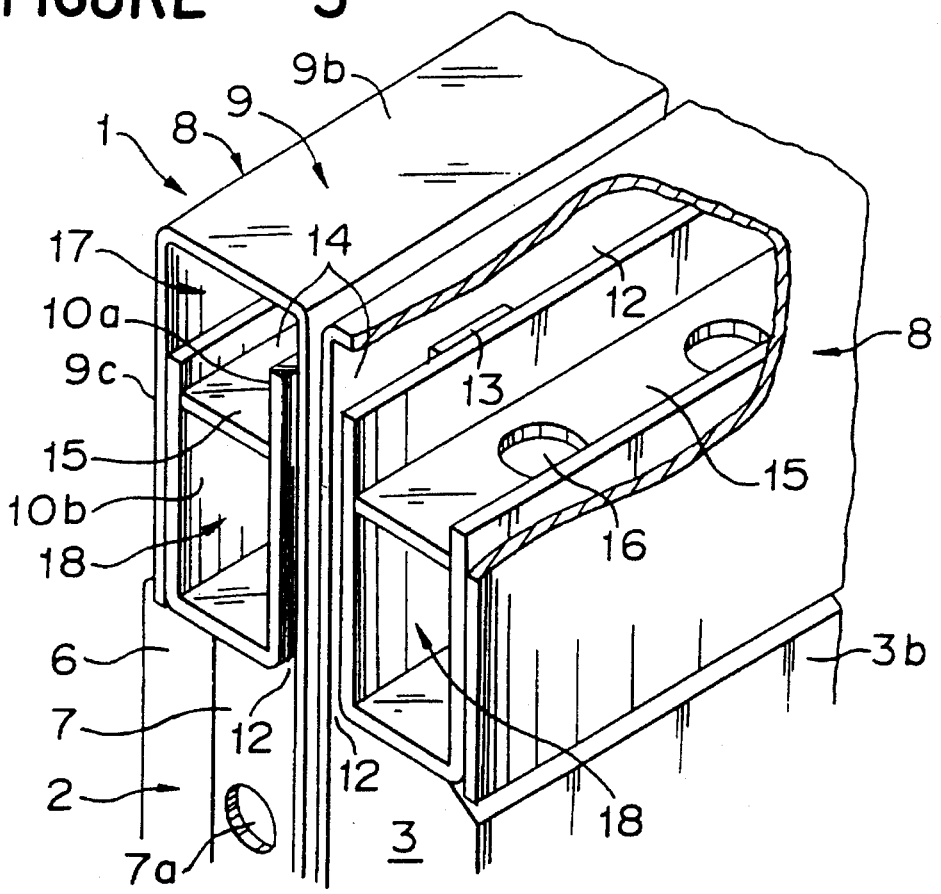
FIG. 3 is a perspective view partly broken of the gas-liquid separator.
Figure 4:
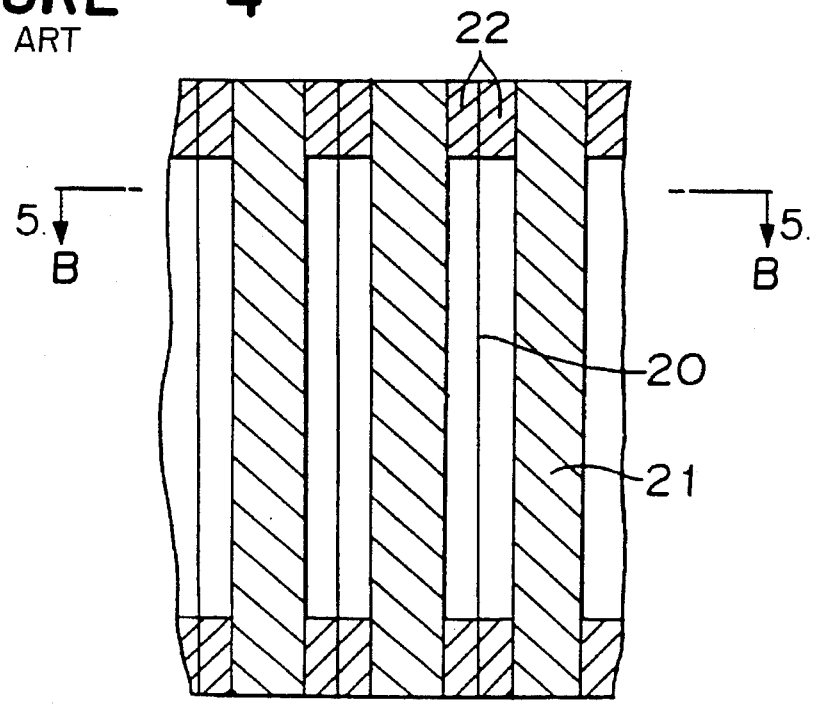
FIGURE 4 PRIOR ART
FIG. 4 is a longitudinal cross-sectional view of the bipolar ion exchange membrane electrolytic cell, which is observed from a side.
Figure 5:
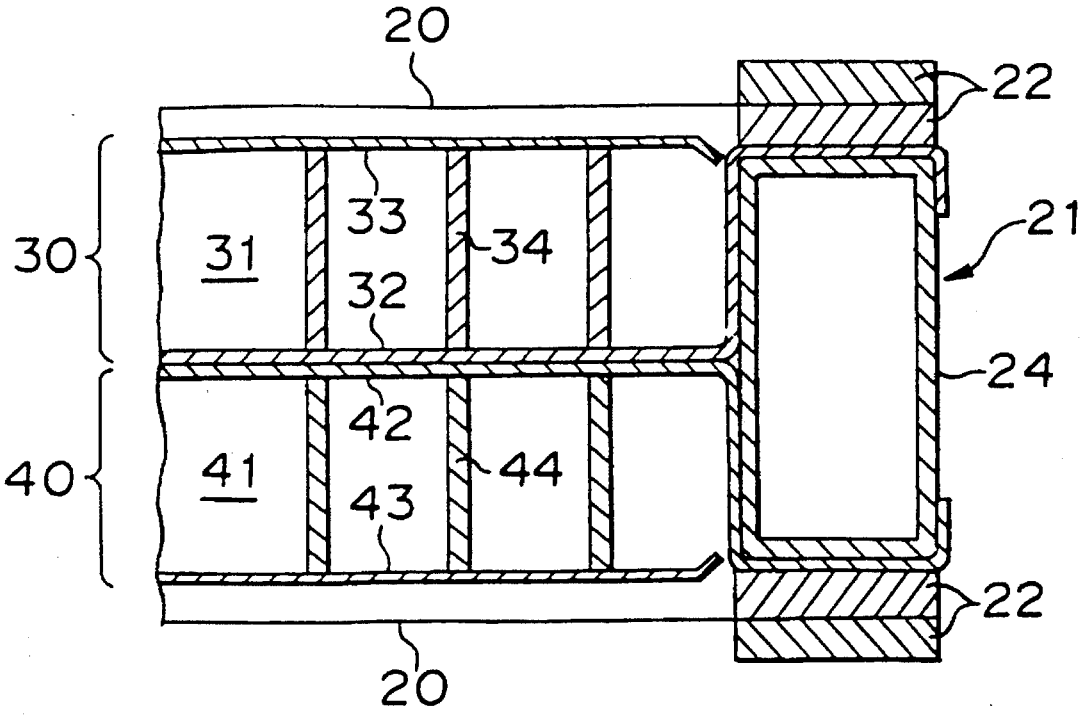
FIGURE 5 PRIOR ART
FIG. 5 is a transverse sectional view taken along a line B—B in FIG. 4.

In FIGS. 1 to 3, a compartment frame unit 1 of the bipolar ion exchange membrane electrolytic cell of the present invention comprises an anode compartment frame 2 and a cathode compartment frame 3 which are connected back to back each other. The anode compartment frame 2 is composed of a back plate 5, a meshed anode plate 6 arranged substantially in parallel to the back plate 5, and ribs 7, supporting members, arranged between the back plate 5 and the anode plate 6 to maintain a space therebetween. Each of the supporting members 7 is provided with openings 7*a* at desired locations so as to communicate an anolyte in the compartment. On the other hand, the cathode compartment frame 3 comprises a cathode side back plate 3*a*, a cathode plate 3*b* and supporting members or ribs 3*c*. Numerals 4 designate gaskets and numerals 1*a* designates ion exchange membranes.

The back plate 5 and the supporting members 7 of the anode compartment frame 2 are made of, for instance, titanium or a titanium alloy, and the anode plate 6 is composed of an electric-conductive meshed titanium plate on which is coated titanium oxide or an oxide of precious metal (for example, ruthenium oxide, iridium oxide and the like).

The construction of the cathode compartment frame 3 is similar to that of the anode compartment frame 2. The cathode plate 3*b* is composed of an electric-conductive meshed plate having corrosion resistance to alkalis, which is made by coating a substrate made of, for example, iron, nickel, stainless steel and the like, with Raney nickel or precious metal. The back plate 3*a* and the supporting members 3*c* are made of a material such as iron, nickel, stainless steel or the like.

The presence of the electrode plates 6, 3*b* in the electrolytic cell forms a electrolysis area. A gas-liquid separator 8 is provided in the non-electrolysis area at an upper portion of each of the anode compartment frames 2 or the cathode compartment frames 3. In the gas-liquid separator 8, an outer frame 9 is formed by bending outwardly an upper portion of the back plate 5 of the anode compartment frame 2 to form an inversed U-shaped portion. A U-shaped channel member or part 10 is disposed in the outer frame 9 such that respective opening ends of the U-shaped channel member 10 and the outer frame 9 face each other to form a gas-liquid separating chamber 11.

The outer frame 9 of the gas-liquid separator 8 has an inner side portion 9*a*, an upper portion 9*b* and an outer side portion 9*c*. The lower end 9*d* of the outer side portion 9*c* of the outer frame 9 is firmly attached to at a position near the lower end of an outer side portion 10*b* of the channel member 10 by means of Tig welding or the like.

In case that the outer side portion 9*c* of the outer frame 9 covers only the upper end of the outer side portion 10*b* of the channel member 10, welding has to be carefully made in a linear form so as not to cause liquid leaking which may result in the distortion of the compartment frame. As shown in FIG. 2, however, when the outer side portion 9*c* of the outer frame 9 is extended to a position near the lower end of the outer side portion 10*b* of the channel member 10, there is no possibility of liquid leakage and thus spot welding can be used.

A gap or space is formed as a passage 12 for the gas-liquid mixed phase stream between an inner side portion 10*a* of the channel member 10 and the inner side portion 9*a* of the outer frame 9. As shown in FIG. 3, spacers 13 are disposed at desired locations in the passage 12 whereby a predetermined distance can be maintained for the gap when a number of the compartment frame units 1 each comprising the anode compartment frame 2 and the cathode compartment frame 3 are pressed through the gaskets 4 from both sides. The channel member 10 and the spacers 13 may be made of the same material as the back plates, for instance.

It is preferable that the inner side portion 10*a* of the channel member 10 is made higher than the outer side portion 10*b*. A gap is formed as an inlet 14 for introducing the gas-liquid mixed phase stream going up through the passage 12 into the gas-liquid separating chamber, formed by the upper end of the inner side portion 10*a* of the channel member 10 and the upper portion 9*b* of the outer frame 9.

A holding member or a supporting plate 15 is disposed substantially horizontally at substantially middle position in each of the channel members 10. The holding member 15 has dispersed openings 16. The holding member 15 can maintain the channel member 10 at a constant width when the compartment frame units are pressed from both sides, and also can function as a separating plate for separating a gaseous phase from a liquid phase in the gas-liquid separating chamber 11 wherein a gas phase chamber is formed in an upper portion 17 with respect to the holding member 15 and a liquid phase chamber is formed in a lower portion 18 with respect to the holding member 15.

Figure 6:
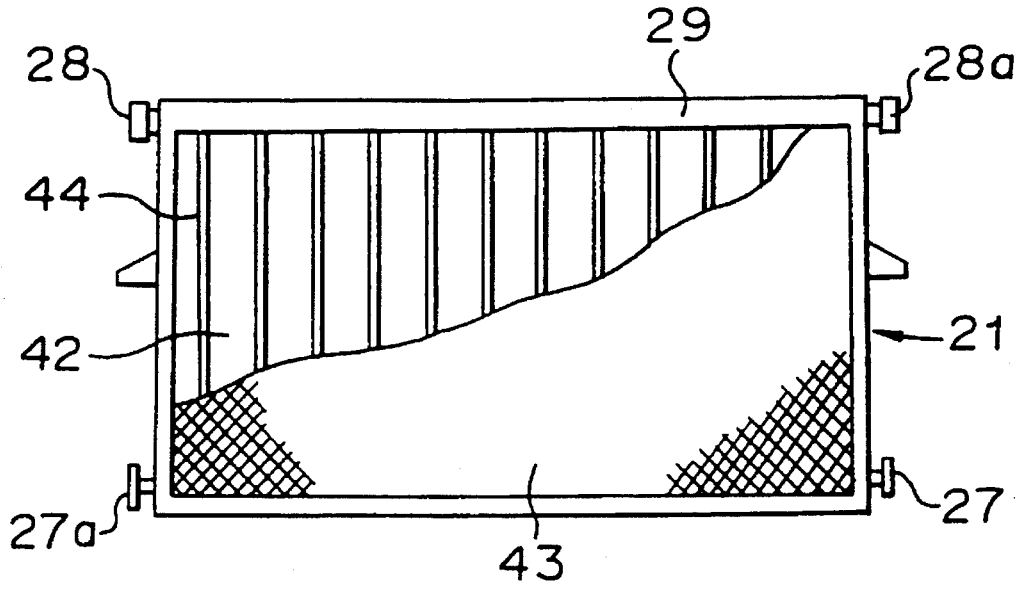
FIG. 6 is a front view of a compartment frame unit.

Each of the compartment frame units 2, 3 has, for example, width of about 240 cm, height of about 120 cm, and thickness of about 2 cm thick when it is observed from the front (FIG. 6). The size of the gas-liquid separating chamber 11 is such that, for instance, the length of the outer side portion 9c of the outer frame 9 is about 60 mm and the width of the upper portion 9b is about 20 mm. The dimension A of the inlet 14 formed between the upper end of the inner side portion 10a of the channel member 10 and the upper portion 9b of the outer frame 9 is about 10 mm. The dimension A is preferably 5–30% of the height of the gas-liquid separating chamber 11, more preferably, 10–20%.

The height of the outer side portion 10b of the channel member 10 may be almost same as that of the inner side portion 10a. By increasing the height of the outer side portion 10b, however, the outer side portion 10b having a reduced height facilitates operations for arranging the holding member 15 in the channel member 10. The width of the passage 12 is made to be about 2 mm. The width of the passage 12 is preferably 5–20% of the width of the compartment frame 2,3, more preferably, 7–15%.

In the bipolar ion exchange membrane electrolytic cell of the present invention, when the gas-liquid mixed phase stream which has passed upwardly in each of the anode compartment frames 2 further goes up in the narrow passage 12 at the side of the back plate 5, the mixed phase stream becomes a bubble flow wherein small bubbles disperse in a liquid phase, and the bubble flow enters into the gaseous phase chamber 17 of the gas-liquid separating chamber 11 through the inlet 14. The liquid phase in the bubble stream in the gaseous phase chamber 17 enters into the liquid phase chamber 18 through the opening 16 of the holding member 15. Since the gas-liquid mixed phase stream passing upwardly through the passage 12 is first fed to the gaseous phase chamber of the gas-liquid separating chamber, separation between the gaseous phase and the liquid phase can be rapidly carried out. The gaseous phase and the liquid phase separated in the gas-liquid separating chamber 11 are moved laterally (the back and forth directions in FIG. 2 or the left and right directions in FIG. 6) to be discharged through the outlets 28 in FIG. 6. The same flow are obtainable in the cathode compartment frames 3.

The back plates 5, 3a may be made of material different from that of which the gas-liquid separator 8 is made. However, it is advantageous to use the same material because the number of welds may be reduced and processing may become easy. Further, in place of the U-shaped channel member 1, an L-shaped member, which is a modification of the U-shaped member, may be used to form the passage 12 at the side of the back plates 5, 3a with respect to the gas-liquid separating chamber 11.

Now, the present invention will be described in further detail with reference to Examples. However, it should be understood that the present invention is by no means restricted by such specific Examples.

EXAMPLE 1

Electrolysis tests were carried out by using the bipolar ion membrane electrolytic cell having compartment frame units each comprising anode and cathode compartment frames and gas-liquid separators of the present invention to measure values of pressure change in the anode compartment frames. The dimensions of the electrode plate in each of the compartment frames were 240 cm wide and 120 cm high. An expanded meshed titanium plate of a thickness of 1.7 mm was used for each anode plate, and a punched meshed nickel plate of a thickness of 1.2 mm was used for each cathode plate. Titanium plates of a thickness of 1.2 mm were used for anode side back plates and titanium plates of a thickness of 2.0 mm and a width of 30 mm were used for supporting members or ribs. 24 ribs were arranged in the longitudinal direction at equal intervals and were fixed to the back plates and the electrode plates by welding. Nickel plates of a thickness of 1.2 mm were used for the cathode side back plates, and nickel plates of a thickness of 1.0 mm and a width of 30 mm were used for the supporting members. 24 ribs were arranged at equal intervals in the longitudinal direction with respect to the electrolysis area cell, and were fixed to the back plates and the electrode plate by welding.

In each of the gas-liquid separators, the height, the width, and the dimension A of the inlet 14 and the width of the passage 12 were 60 mm, 30 mm, 10 mm and 2 mm respectively. 24 Pieces of spacers 13 having a thickness of 2 mm, a width of 5 mm and a height of 50 mm were arranged at equal intervals in order to assure the distance of the passage 12.

In each of the U-shaped channel members, the holding member or the supporting plate was horizontally fixed at a position 25 mm apart from the upper end of the outer frame 9. 24 Openings having a diameter of 12 mm were formed in the holding member 15 at equal intervals.

The chamber frame units each comprises the anode compartment frame and the cathode compartment frame and the ion exchange membranes were arranged alternately by interposing the gaskets. Then, this assembly was fastened from both sides by a cell frame made of iron thereby forming a bipolar ion exchange membrane electrolytic cell. For the ion exchange membranes, Flemion membrane F-893 (manufactured by Asahi Glass Company Ltd.) was used.

An aqueous solution of NaCl of 300 g/l was introduced through an inlet 27 which is located at a lower portion of the compartment frame units so that the concentration of the solution of salt at an outlet 28 for the anode compartments was 210 g/l, and dilute sodium hydroxide aqueous solution was introduced through an inlet 27a which is located at a lower portion of the compartment frames so that the concentration of sodium hydroxide aqueous solution at an outlet 28a for the cathode compartments was 32 wt %.

Electrolysis tests were carried out under the conditions of a temperature of electrolyte of 90° C. and a current density of 5 $KA/m^2$ to measure values of pressure fluctuation. Results are shown in Table 1. After the operations of 6 months, the electrolytic cell was disassembled to observe and inspect the ion exchange membranes. As a result, there was no abnormality in the appearance and the strength of the membrane.

TABLE 1

| | Current density ($KA/m^2$) | Voltage (V) | Values of pressure fluctuation in anode compartment (mm $H_2O$) |
|---|---|---|---|
| Example 1 | 5 | 3.22 | 24 |
| Example 2 | 4 | 3.04 | 18 |
| Example 3 | 3 | 2.86 | 10 |

EXAMPLE 2

Electrolysis tests were conducted under the same condition as Example 1 except that the current density was 4 $KA/m^2$. The measured value of pressure fluctuation is shown in Table 1. After the operations of 6 months, the electrolytic cell was disassembled. However, no abnormality was found.

EXAMPLE 3

Electrolysis tests were conducted under the same condition as Example 1 except that the current density was 3

KA/m$^2$. The measured value of pressure change is shown in Table 1. After the operations of 6 months, the electrolytic cell was disassembled. However, no abnormality was found.

COMPARATIVE EXAMPLE 1

A bipolar ion exchange membrane electrolytic cell in which the size of the electrode plates, the material for the electrode plates, the back plates and the ion exchange membranes were the same as those in Example 1, was used. However, the gas-liquid separating chambers were respectively formed within compartment frames constituted by the electrode plates and the back plates at the electrolysis area. Each of the gas-liquid separating chambers was formed by fixing an L-shaped member to the back plate at an upper portion of the compartment frame constituted by the electrode plate and the back plate so that the gas-liquid mixed phase stream passing upwardly in the compartment frame passed through the passage between the L-shaped member and the electrode plate and entered into the gas-liquid separating chamber through an inlet formed between an upper portion of the L-shaped member and an upper portion of the compartment frame. The width of the passage was 10 mm; the height of the L-shaped member was 60 mm and the height of the space as the inlet was 10 mm.

Electrolysis tests were conducted under the same conditions as Example 1 to measure values of pressure fluctuation. A result obtained is shown in Table 2. After the operations of 3 months, the electrolytic cell was disassembled to observe and inspect the ion exchange membranes. Upper portions of the membranes exhibited a white color due to the stagnation of gas, and the strength of those portions of the membranes were clearly lower than those of an intermediate portions or a lower portions.

TABLE 2

| | Current density (KA/m$^2$) | Voltage (V) | Values of pressure fluctuation in anode compartment (mm $H_2O$) |
|---|---|---|---|
| Comparative Example 1 | 5 | 3.30 | 70 |
| Comparative Example 2 | 4 | 3.10 | 45 |
| Comparative Example 3 | 3 | 2.90 | 24 |

COMPARATIVE EXAMPLE 2

Electrolysis tests were conducted under the same conditions as Comparative Example 1 except that the current density was 4 KA/m$^2$ to measure values of pressure change. A result obtained is shown in Table 2.

COMPARATIVE EXAMPLE 2

Electrolysis tests were conducted under the same conditions as Comparative Example 1 except that the current density was 3 KA/m$^2$ to measure values of pressure change. A result obtained is shown in Table 2.

The results in Table 1 and Table 2 show that the values of pressure fluctuation in the anode compartments of the ion exchange membrane bipolar electrolytic cell in Examples 1 to 3 are lower than those of the electrolytic cell in Comparative Examples 1 to 3, and there is less influence to the ion exchange membranes.

In accordance with the present invention, there is a small possibility of stagnation of gas at a lower portion of the outer side of the gas-liquid separating chambers since gas-liquid mixed phase streams passing upwardly in the compartment frames are sucked by siphon action and introduced into the gas-liquid separating chambers through the passages formed in a side portion of the gas-liquid separating chambers. Further, when the gas-liquid mixed phase stream passes through the narrow passage, the mixed phase stream becomes a bubble flow wherein small bubbles are dispersed. Thus, separation of a gaseous phase from a liquid phase can be smoothly carried out and the separated phases can be discharged quickly out of the compartment. Accordingly, there is almost no pressure fluctuation or voltage variation in the compartment frames, and stable operations can be obtained at a high current density of 4 KA/m$^2$ or higher even under a high temperature condition.

Since each of the gas-liquid separators is disposed in each of non-electrolysis areas of the electrolytic cell and the passage to each of the gas-liquid separators is formed at the back plate side, gas does not stagnate at the side of the meshed electrode plates, in particular, between the electrode plates and the ion exchange membranes. Thus, there is a small possibility that the ion exchange membranes deteriorate.

Each of the gas-liquid separators is formed by outwardly bending an upper portion of the back plate of each of the compartment frames in a form of an inversed U-shape. A U-shaped channel member is disposed and fixed to the outwardly bent portion to provide a space for a passage between the U-shaped channel member and the back plate. Accordingly, the number of Tig welds can be reduced and manufacturing process can be simplified while the compartment frames having high rigidity can be obtained.

Further, a holding member is disposed in each of the gas-liquid separating chambers so as to extend in its longitudinal direction wherein a gaseous phase chamber is formed in an upper portion with respect to the holding chamber and a liquid phase chamber is formed in a lower portion with respect to the holding member in the gas-liquid separating chamber. Accordingly, there is no possibility that the gas-liquid separating chambers deform even when pressed from both sides. Further, since the gaseous phase chamber and the liquid phase chamber are divided by the holding member, a gaseous phase and a liquid phase can be smoothly discharged to the outside of the compartment, and a pressure fluctuation in the compartment is minimized. Further, since the bubble flow going up through the passage is firstly introduced into the gaseous phase chamber of the gas-liquid separating chamber, the separation of the gaseous phase from the liquid phase is effectively carried out.

What is claimed is:

1. A bipolar ion exchange membrane electrolytic cell comprising:

plural compartment frame units having ion exchange membranes interposed therebetween, each of said compartment frame units including an anode compartment frame and a cathode compartment frame;

said anode compartment frame having an anode back plate and an anode meshed electrode plate arranged substantially in parallel, said cathode compartment frame having a cathode back plate and a cathode meshed electrode plate arranged substantially in parallel, said anode and cathode back plates being connected to each other;

an inverse U-shaped portion formed by bending an upper portion of each of said anode and cathode back plates;

a U-shaped channel member arranged in and fixed to said inverse U-shaped portion such that respective opening ends of said inverse U-shaped portion and said U-shaped channel member face each other to form a gas-liquid separating chamber therein and a passage between said anode or cathode back plate and said U-shaped channel.

2. A bipolar ion exchange membrane electrolytic cell according to claim 1, further comprising a holding member having openings and arranged substantially horizontally in said U-shaped channel member to divide said gas-liquid separating chamber into a gaseous phase chamber and a liquid phase chamber.

3. A bipolar ion exchange membrane electrolytic cell according to claim 1, wherein a width of said passage is 5–20% of a width of said anode compartment frame.

4. A bipolar ion exchange membrane electrolytic cell according to claim 1, wherein a width of said passage is 5–20% of a width of said cathode compartment frame.

5. A bipolar ion exchange membrane electrolytic cell according to claim 1, wherein said gas-liquid separating chamber has an inlet size which is 5–30% of a height of said gas-liquid separating chamber.

* * * * *